United States Patent [19]

McClure

[11] 4,299,417

[45] Nov. 10, 1981

[54] TAMPER PROOF PLASTIC SECURITY SEAL

[75] Inventor: Kenneth R. McClure, St. Charles, Ill.

[73] Assignee: Dickey Manufacturing Company, St. Charles, Ill.

[21] Appl. No.: 127,772

[22] Filed: Mar. 6, 1980

[51] Int. Cl.[3] ..... B65D 33/34

[52] U.S. Cl. ..... 292/320

[58] Field of Search ..... 248/74 PB; 24/16 BP; 292/307, 317–325

[56] References Cited

U.S. PATENT DOCUMENTS

| | | | |
|---|---|---|---|
| 2,542,479 | 2/1951 | Costner | 24/16 PB |
| 2,915,268 | 12/1959 | Wrobel | 248/74 PB |
| 3,106,028 | 10/1963 | Baumgartner | 24/16 PB X |
| 3,146,012 | 8/1964 | King, Sr. | 292/320 |
| 3,367,701 | 2/1968 | Wenk, Jr. | 24/16 PB |
| 3,556,575 | 1/1971 | Farkas | 292/318 X |
| 3,712,655 | 1/1973 | Fuehrer | 292/321 |
| 3,717,369 | 2/1973 | Steffel | 292/321 |
| 3,842,688 | 10/1974 | Baginski | 24/16 PB |
| 4,121,880 | 10/1978 | Rollins et al. | 248/74 PB |

FOREIGN PATENT DOCUMENTS

| | | | |
|---|---|---|---|
| 1212605 | 10/1959 | France | 248/74 PB |

*Primary Examiner*—Richard E. Moore
*Attorney, Agent, or Firm*—McWilliams, Mann & Zummer

[57] ABSTRACT

A tamper proof all plastic one piece security seal comprising a shackle or securing strap and retainer in which the retainer comprises a body having a keeper portion, defining a latching cavity, and a flange portion integral with one side of the keeper portion and also integral with one end of the shackle or securing strap. The other end of the shackle or strap is formed to define a rectilinear latching segment that has elastic memory, and is formed to define recesses spaced apart longitudinally thereof for free fitting relation with correspondingly located lugs formed in the latching cavity when the shackle latching segment is in its locked position. The latching cavity lugs and the latching segment recesses are oriented to require force fitting or feeding of the latching segment within the latching cavity such that bending distortion of the latching segment, laterally of same, will be necessary to bring the latching segment recesses into registry with the latching cavity lugs, whereupon the elastic memory of the latching segment will restore same to its rectilinear unstressed relation that locks the latching segment permanently within the latching cavity. The shackle or strap latching segment includes flanges for masking the latching cavity against violation when the seal is in its locked relation, and a frangible connection that integrally connects the latching segment as part of the shackle provides for ready breakage of the shackle to evidence tampering.

6 Claims, 13 Drawing Figures

TAMPER PROOF PLASTIC SECURITY SEAL

This invention relates to security seals of the plastic type, and more particularly, to a one piece all plastic security seal of the general type where the major function of the seal is to deter thievery or even tampering with the seal by being arranged to indicate that the seal has not been violated, by indicating freedom from tampering, as distinguished from physically preventing removal.

Seals of this general type are commonly used to seal closed electric meters, liquor kits for airline use, crash carts for hospitals, fire extinguishers, and the like, where the major function of the seal is to indicate that the seal has not been broken or tampered with, as distinguished from physically preventing violation of the seal. A basic intention for seals of this type is that they will not open without the seal being destroyed, and re-use is not possible, in addition to indicating that the seal has been tampered with, if not forced.

This invention is also specifically concerned with seals of this general type that are of the inexpensive all plastic one piece construction category, in which the seal arrangement is to provide its tamper proof functions by having specifics that insure easy and effective application of the seal in a manner that precludes opening of the seal without destroying same, and yet provides a specific seal arrangement that is readily mass produced in a form that insures effective tamper proof application for each individual seal.

Security seals of the general type involved commonly present problems of providing a secure latching function that resists prying apart using common tools, while providing a latching arrangement that is uniformly effective for each application. The seals of this general type that are available or have been proposed are all frequently found to be so arranged as to permit a tool such as a screw driver or a sharp pointed punch to be effectively applied to the seal by those who have the expertise involved, to separate the locked seal parts without destroying them, or perhaps not even noticeably defacing the seal itself. Also involved in seals of this type is the need to be sure that the shackle or securing strap end when fully applied to the seal retainer is held fast against withdrawal even though the cooperating latch means involved are blocked from view by the presence of the shackle locking end within the seal retainer.

The principal object of the present invention is to provide a security seal of the all plastic one piece construction type in which the retainer defines a latching cavity in the shackle or securing strap free end defines a latching segment, with the latching segment being received for latching purposes in the latching cavity in such a manner that the retainer fully masks the cooperating latch means involed, and the shackle latching segement bars entry into the latching cavity of tools such as a pick or screw driver for the purpose of forcing the seal.

Another principal object of the invention is to provide a security seal of the type indicated in which the retainer latching cavity and the shackle latching segment are specially formed for guided force fitting of the latching segment into and along the latching cavity in such a manner that as the latching segment moves toward its locked position, it is subjected to bending stress and distortion, but when it reaches the full latched position, registry of cooperating lug and recess latch components occurs so that the elastic memory of the latching segment is enabled to restore the latching segment to its unstressed normal rectilinear relation that provides the locking relationships involved in cooperation with the latching cavity lugs.

Another object of the invention is to provide a security seal of the one piece all plastic construction type that is uniformly effective for security seal purposes, that requires no tools or special expertise to apply, that is economical of manufacture, convenient to package and store, and long lived in application barring efforts to force same.

In accodance with the invention, the seal comprises a retainer and associated shackle in one piece construction form and formed from a suitable plastic material, such as polyethylene, polypropolene, or nylon, in which the retainer comprises a body having a keeper portion forming a bottomed latching cavity of tubular rectilinear configuration, and a flange portion integral with one side of the keeper and that is in coplanar relation with the latching cavity central axis. The retainer flange is integral with one end of the shackle or securing strap, at a point spaced from the keeper portion, and the other end of the shackle or securing strap is for manual application to the latching cavity, and is formed to define a rectilinear latching segment that has elastic memory and defines spaced recesses separated longitudinally of the segment for free fitting relation with correspondingly located lugs formed in the latching cavity at the position where the latching segment is to be in locked relation with the retainer. The latching cavity lugs and the latching segment recesses are oriented and proportioned to require force fitting of the latching segment within the latching cavity and exert a camming action on same such that bending distortion of the latching segment laterally of same will be necessary to bring the latching segment recesses into registry with the latching cavity lugs, whereupon the elastic memory of the latching segment will restore same to its rectilinear unstressed relation that locks the latching segment permanently within the latching recess of the retainer. The shackle latching segment includes flanges for masking the latching cavity against violation in the locked relation of same, and the latching segment is connected to the shackle proper by a frangible connection that provides for ready breakage of the shackle to evidence tampering.

Other objects, uses, and advantages will be obvious or become apparent from a consideration of the following detailed description and the application drawings in which like reference numerals indicate like parts throughout the several views.

Figure 1:
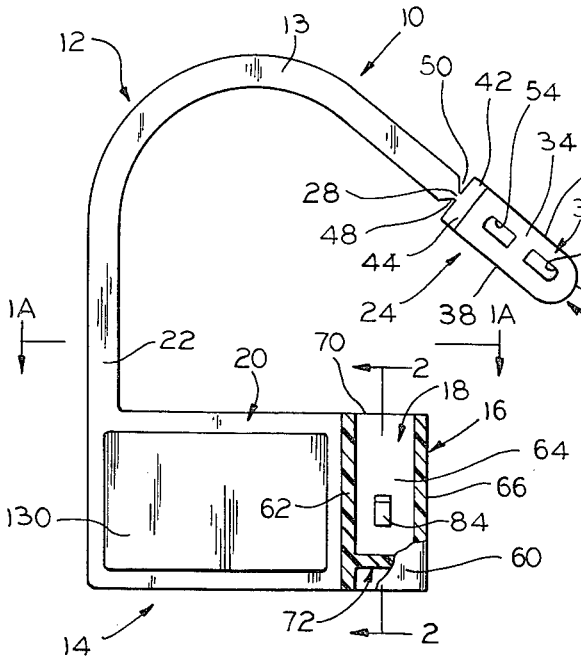
FIG. 1 is a plan view of one embodiment of the invention, with the seal shackle in open relation, and with a portion of the seal retainer broken away.
Figure 1A:
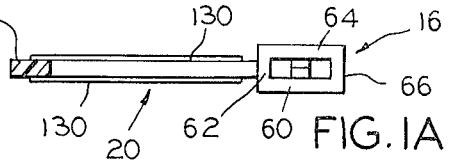
FIG. 1A is a sectional view taken along line 1A—1A of FIG. 1.
Figure 2:
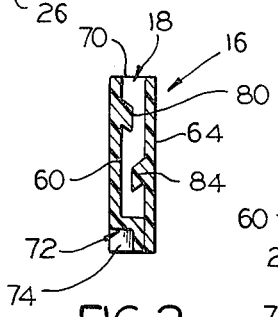
FIG. 2 is a sectional view taken substantially along line 2—2 of FIG. 1, illustrating the latching lugs of the seal retainer.
Figure 3:
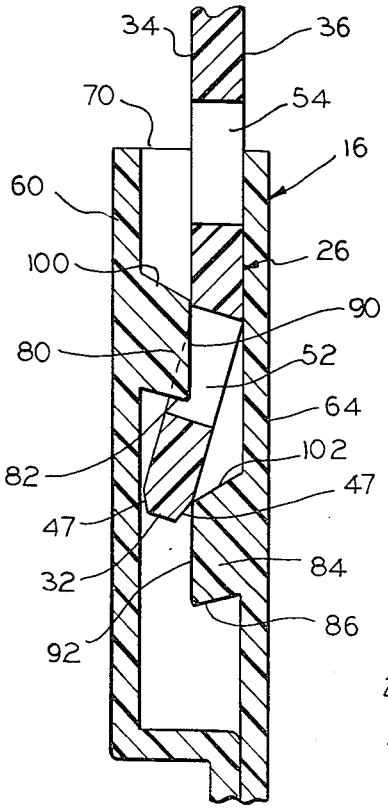
FIGS. 3, 4 and 5 are views comparable to that of FIG. 2, showing the shackle free end latching segment being applied to the seal retainer, but on an enlarged scale.
Figure 4:
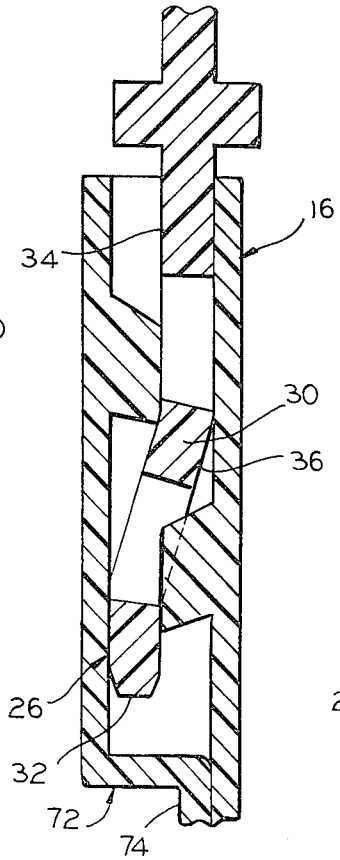
Figure 5:
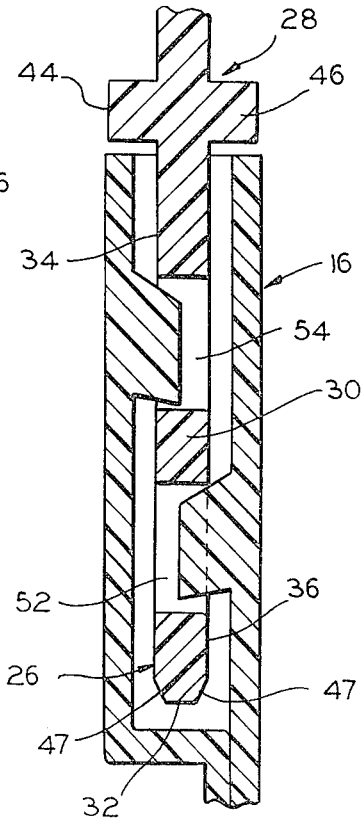
Figure 7:
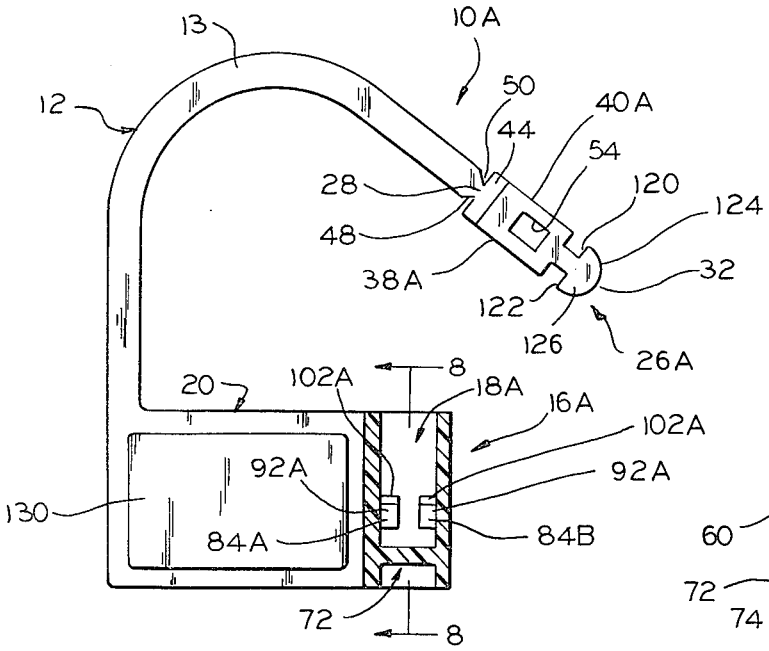
FIG. 7 is a view similar to that of FIG. 1, but illustrating a modified form of the invention.
Figure 8:
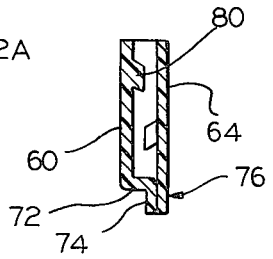
FIG. 8 is a sectional view through the keeper portion of the seal in FIG. 7, taken along line 8—8 of FIG. 7.
Figure 9:
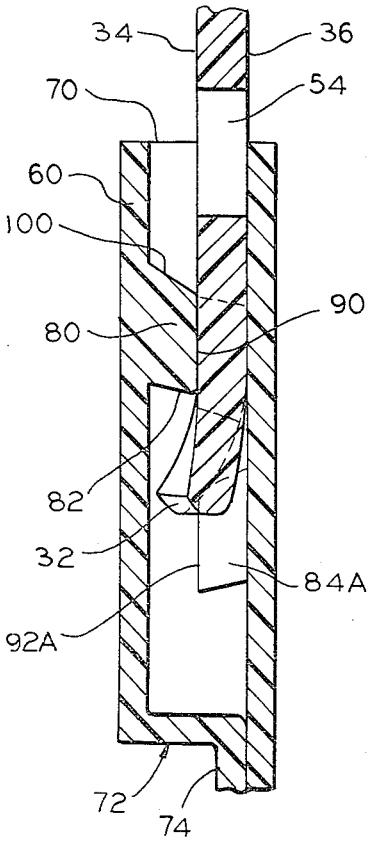
Figure 10:
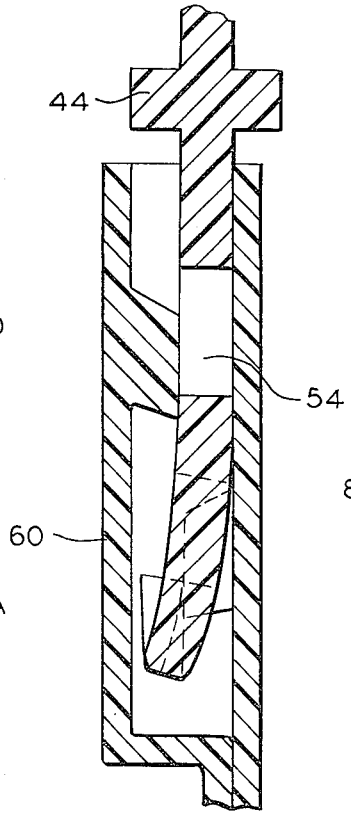
Figure 11:
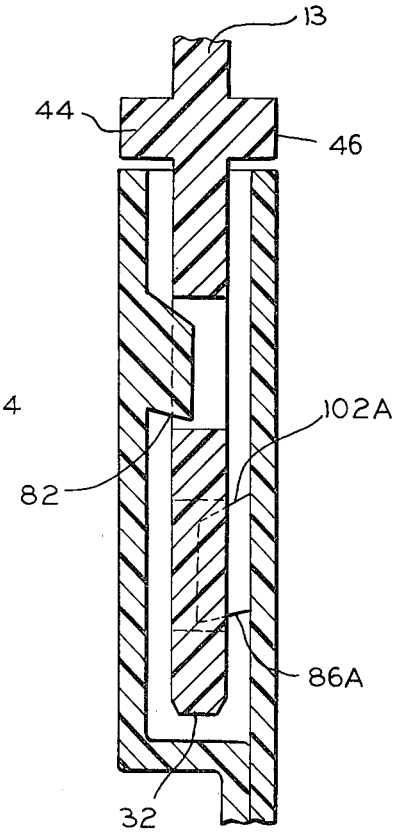
Figure 12:
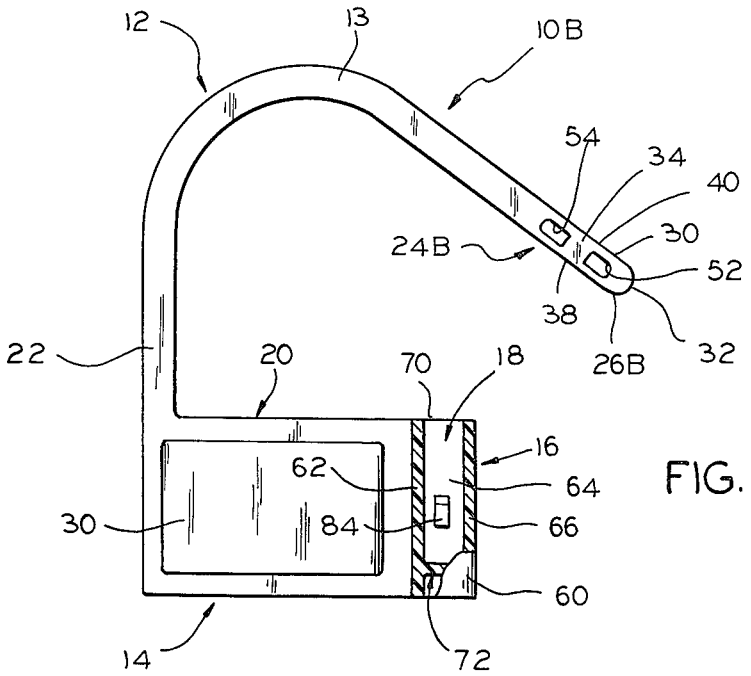
Figure 13:
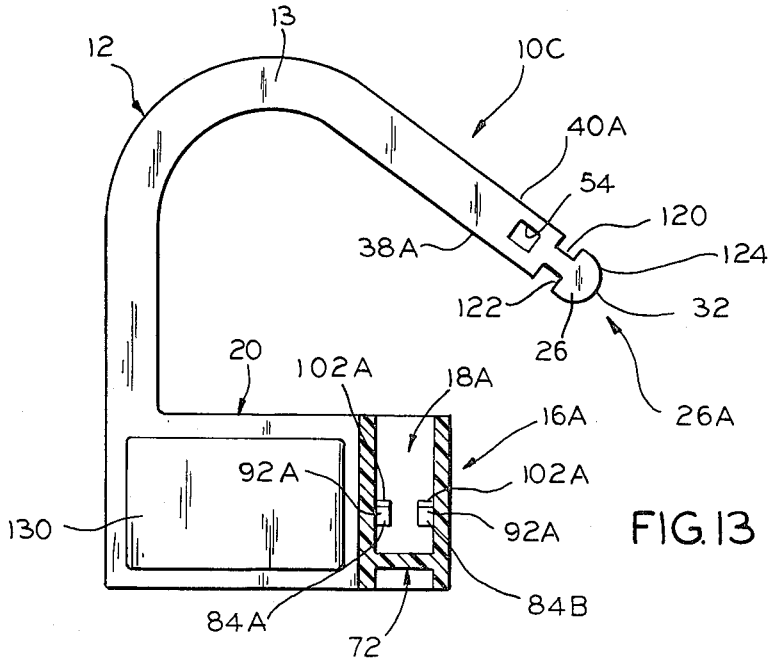

FIGS. 9, 10 and 11 are views similar to those of FIGS. 3, 4 and 5, but illustrating the application of the latching segment of the embodiment of FIG. 7 to the seal keeper portion; and FIGS. 12 and 13 correspond to FIGS. 1 and 7, respectively, illustrating simplified variants of these two embodiments of the invention.

However, it is to be distinctively understood that the specific drawing illustrations provided are supplied primarily to comply with the requirements of the Patent Laws, and that the invention is susceptible of modifications and variations that will be obvious to those skilled in the art, and which are intended to be covered by the appended claims.

Reference numeral 10 of FIG. 1 illustrates a preferred embodiment of the invention in which the seal 10 comprises a shackle or securing strap 12 and retainer 14. Retainer 14 comprises a tubular keeper portion 16 forming a latching cavity 18, with the keeper portion 16 being integral with a flange portion 20 that is centered on and extended in coplanar relation with the central axis 21 of the latching cavity 18. The retainer flange portion 20 has one end 22 of the shackle 12 integrally connected therewith, while the other end 24 of the shackle 12 is formed to define a special latching segment 26 that is integral with the shackle 12 at a frangible connection 28.

The latching segment 26 comprises a elongate head 30 of planar, rectilinear shaping that is generally of quadrilateral section in transverse cross-sectional configuration and is shaped to define a rounded insert end portion 32, opposed side surface 34 and 36, and opposed edge surfaces 38 and 40, the latter merging together at the rounded end portion 32. The latching segment 26 has a flanged end portion 42 comprising oppositely projecting flanges 44 and 46 that serve to mask the cavity 18 when a latching segment 26 is applied to the latching cavity 18. The leading end portion 32 in addition to being rounded is also chamfered or beveled at the latching segments side surfaces 34 and 36, as indicated at 47 in FIGS. 3–5.

The frangible connection 28 in the form shown is defined by notches 48 and 50 formed in the shackle proper 13 whereby the frangible connection 28 is in the form of a reduced neck type connection effecting integral securement of the latching segment 26 with the shackle proper 13. The shackle proper 13 is of quadrilateral configuration in transverse section in the form illustrated.

The latching segment 26, in accordance with the invention, is formed with a pair of spaced apart recesses 52 and 54 that are in the form of through openings extending between the latching segment sides 34 and 36, and that are aligned longitudinally of the latching segment 26 and in axial alignment therewith.

The keeper portion 16 of retainer 14 is of tubular circumambient wall structure configuration defining imperforate side walls 60, 62, 64 and 66 that form the latching cavity 18 which has open end 70 to freely receive the shackle latching segment 26, and a closed end 72, which in the form illustrated is provided by indenting the underside 74 of the wall 60 against wall 64, and heat sealing same in seal abutting relation thereto as at 76.

In accordance with the invention, the keeper portion walls 60 and 64, in the embodiment of FIGS. 1–6, are each formed to define a latching lug positioned to be freely received in the respective flue openings 52 and 54 of the latching segment 26 when the latching segment 26 is disposed within the latching cavity 18 to be in registry therewith. Thus, wall 60 is formed to define latching lug 80 shaped to define latching shoulder 82, while wall 64 is formed to define latching lug 84 having latching shoulder 86.

Figure 6:
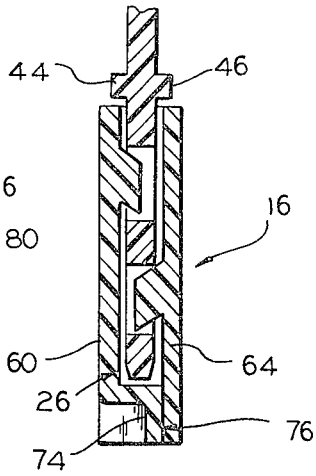
FIG. 6 is similar to FIG. 5, but on a smaller scale and showing the shackle latching segment in latched relation with the retainer keeper portion.

It is to be noted that the latching lugs 80 and 84 both project inwardly of the cavity 18 approximately one-half the distance across same (see FIGS. 1A and 3–5), with the lugs 80 and 84 being spaced apart longitudinally of the recess 18 to coincide with the spacing of the latching segment openings 52 and 54 for registry therein, as indicated in FIGS. 5 and 6.

It will also be observed from FIGS. 3 and 4 that the thickness of the latching segment 26, that is the dimension between its side surfaces 34 and 36, approximates or substantially complements the distance between the land portions 90 and 92 defined by the respective latching lugs 80 and 84 and the opposing keeper portion sides 60 and 64 opposite same. Latching segment 26 has a width dimension, between edge surfaces 38 and 40, that substantially complements the distance between the retainer keeper portion walls 62 and 64.

As already indicated, it is a feature of the invention that the seal 10 be of one piece construction formed from a suitable plastic material, such as polyethylene, polypropolene, or nylon, having elastic memory, which is of major importance insofar as the latching segment 26 is concerned. It will be noted from FIGS. 1, 5 and 6 that the latching segment 26 in its normal unstressed relation is of planar rectilinear configuration, and a feature of the invention is that when the latching segment 26 is bent sidewise of same, that is laterally of the planes of its side surfaces 34 and 36, when released the built in elastic memory involved will return the latching segment 26 to its normal planar, rectilinear unstressed relation indicated in FIGS. 1, 5 and 6.

Further in accordance with the invention, when the seal 10 is to be employed to perform its sealing function, the components to be held in sealed relation are disposed within the shackle in the usual manner, as by maneuvering the seal 10 to pass the latching segment 26 about the components to be sealed. The latching segment 26 is then applied to the latching cavity 18 by bending the shackle proper 19 as needed to align the latching segment 26 with the keeper portion 16, and then pressing the latching segment 26 inwardly of the cavity 18, with finger pressure being applied to the flanges 44 and 46 as needed to achieve this end, but care being taken to not unduly stress the frangible connection 28.

The side edges 38 and 40 of the latching segment as indicated, are spaced to substantially complement the spacing between the side 62 and 66 of the latching cavity 18, so that the latching segment openings 52 and 54 are aligned with the latching cavity lugs 80 and 86 longitudinally of the cavity 18 when the segment 26 is applied thereto, and are held in such alignment as the latching segment 26 is moved longitudinally of keeper portion 16. As the leading end 32 of the latching segment 26 moves into cavity 18, it engages angled camming surface 100 of lug 80 and is thus guided to move between the lug land 90 and wall 64 as further movement of the latching segment inwardly of the cavity continues. The latching segment leading end 32 will then engage the camming surface 102 of lug 84 to again be shifted sidewise of the latching cavity so as to move between the land 92 of lug 84 and wall 60. As will be observed from the showing of FIGS. 3 and 4, this induces on the latching segment 26 a significant lateral bending action sidewise of the normal plane of latching segment 26, and thus subjects the latching segment 26 to bending stress. Further movement of the latching segment 26 inwardly of recess 18 continues from the position of FIG. 4 to the position of FIG. 5, when the through openings 52 and 54 of the latching segments 26 are in registry with the respective lugs 80 and 84, whereupon the built in elastic memory of the latching segment 26 restores the latching segment 26 to its normal planar, rectilinear configuration. The respective lugs 80 and 84 are freely received within the respective openings 54 and 52 in free fitting but non-displaceable locking relation thereto. In this position of the latching segment 26 relative to the keeper portion proportion 16, flanges 44 and 46 closely overlie the open end 70 of the cavity 18, and thus cover the sides of the latching cavity 18 on which the respective lugs 80 and 84 are located. This precludes insertion of a thin bladed tool such as screw driver or the like into the latching cavity 18 in furtherance of any effort to try to separate the latching segment from the retainer keeper portion 16.

The seal 10 is thus assembled to perform its sealing function. Efforts to withdraw the latching segment 26 from latching cavity 18 by attempting to pry these two parts apart will leave evidence of tampering on the seal. Efforts to pull the latching segment from the cavity 18 will only fracture the frangible connection 28, thus destroying the seal. For normal seal removal purposes, the frangible connection 28 is broken to legally remove the seal, and when the two components involved are again to be sealed, a fresh seal 10 is employed for this purpose.

FIGS. 7–11 illustrate a seal 10A that is quite similar to seal 10 in many respects, the basic differences being in the formation of the lug receiving recesses of the shackle latch segment 26A and the location of the latching lugs within the latching recess 18A. Identical parts of seals 10 and 10A are given identical reference numerals. The description with reference to the seal 10A will therefore be directed to the modified shackle latching segment 26A and the modified latching recess 18A. As indicated in FIG. 7, the latching segment 26A is provided with the lug receiving through opening 54 of FIG. 1, but in this embodiment of the invention, instead of the through opening 52 being provided, a pair of notches 120 and 122 are formed in the sides 38A and 40A of the latching segment 26A, for cooperation with a pair of spaced apart latching lugs 84A and 84B at the inner end of the latching recess 18A. The lugs 84A and 84B are formed in wall 64 of the seal keeper portion 16A at a level within cavity 18A that is comparable to that of lug 84 of Seal 10. Lug 80 is defined in wall 60 of keeper portion 16A. The recess 54 and notches 120 and 122 are spaced longitudinally of the latching segment 26A for free fitting registry with the respective lugs 80, 84A and 84B when the latching segment 26A is aligned therewith, in the position indicated in FIG. 11.

It will be seen that in this embodiment of the invention, when latching segment 26A is inserted into the retainer keeper portion 16A, the leading end 32 of the latching segment proceeds to and is cammed by lug 80 in the same manner as the embodiment of FIGS. 1–6. However, when the side portions of the latching segment leading end 32 approach the transversely aligned lugs 84A and 84B, they are cammed by the respective camming surfaces 102A of same in the direction of the keeper portion wall 60, and at the same time are subjected to bending stress both laterally of the latching segment 26A and about its longitudinal axis. Further movement inwardly of the latching segment 26A from the position of FIG. 9 to the position of FIG. 10 cams the side edges of the segment leading end 32 over lands 92A of the lugs 84A and 84B, further movement to the position of FIG. 11 bringing the through recess 54 and the notches 120 and 122 into registry with the respective lugs 80 and 84A and 84B, whereupon the built in elastic memory of the latching segment 26A restores same to its normal planar rectilinear relation shown in FIG. 11, wherein the latching shoulder 82 of lug 80 and the latching shoulders 86A of the lugs 84A and 84B permanently latch the latching segment within the retainer keeper portion 16A.

In the illustrated embodiments of the invention, the flange portion 20 is formed with raised surfaces 130 on either side of same to which may be applied suitable trademarking and other identification indicia or the like.

In the seal 10B of FIG. 12, the latching segment 26B at shackle end 24B is a continuation of strap or shackle 12 having the openings 52 and 54 formed therein for cooperation with lugs 80 and 84 of keeper portion 16B, which is of reduced width to complement the reduced corresponding dimension of segment 26B. Thus, frangible connection 28 and flanges 44 and 46 are omitted from seal 10B, though seal 10B is otherwise the same as seal 10, and segment 26B is applied to keeper portion 16B in the same manner as the corresponding parts of seal 10.

In the seal 10C of FIG. 13, the latch segment 26B at shackle end 24C is also a continuation of the shackle 12, with frangible connection 28 and flanges 44 and 46 being omitted, but with segment 26B being otherwise the same as segment 26B of seal 10A. In this form the shackle 12 is shown to be of the same width for its length as shackle segment 26A, and keeper portion 16A is thus employed in seal 10C.

The seals 10B and 10C are otherwise the same as seals 10 and 10A, respectively.

It will therefore be seen that the invention provides in a simple one piece plastic security seal an effective latching arrangement anchoring the shackle latching end within the retainer latching recess. The shackle latching end is in the form of a latching segment formed with recesses positioned for free fitting registration with correspondingly located lugs formed within the retainer latching cavity, with the latching lugs being proportioned and spaced to require a force feeding or snaking of the shackle latching segment through the latching cavity in a manner that subjects the latching segment to bending strain and stress.

When the closing movement of the latching segment reaches the point where the latching segment recesses are in registry with the latching lugs of the retainer latching cavity, the latching segment is freed of restraint and camming, thereby permitting its built in elastic memory to return it to its rectilinear unstressed relation for permanent locking within the retainer latching recess.

The latching segment flanges, where employed, serve to overlie and thus effectively cover the sies of the latching recess on which the latching lugs are located, thereby precluding efforts to insert a flat bladed tool into the latching recess for the purpose of trying to separate the inner locked lugs and recesses.

The frangible connection that integrally connects the shackle latching segment with the shackle proper, where employed, insures that the seal will be broken with only a minor stressing of the shackle to try to separate the shackle from the retainer, and thus evidencing a violation of the seal.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. A tamper proof security seal comprising:

a shackle, a retainer for said shackle, said retainer having a keeper portion defining a latching cavity forming a rectilinear bore, and a flange portion on one side of said keeper portion, with said bore and said flange portion being in coplanar relation, one end of said shackle being made fast to said retainer flange portion, and the other end defining a latching segment that has elastic memory, said latching cavity having opposed inner wall portions that in part form said bore, and having one end of same open to receive said latching segment, one of said latching cavity wall portions having first stop lug means protruding therefrom toward the other of said latching cavity wall portions and located adjacent said cavity open end, with said other of said latching cavity wall portions having second stop lug means protruding therefrom toward said one cavity wall portion and located in said cavity below the level of said first stop lug means, said latching segment having recesses spaced to register respectively with said latching cavity lug means in free fitting relation when said latching segment is in its latching position in said latching cavity whereby in said latching positions said latching segment is in unstressed relation, said lug means protruding lateraly of said cavity for disposing their projecting portions in substantial alignment with the longitudinal axis of said bore, whereby application of said shackle latching segment to its said latching position requires force feeding said latching segment consecutively past said lug and under bending stress to said latching position wherein the latching segment elastic memory restores said latching segment to its unstressed relation for latched relation in said latching cavity.

2. the security seal set forth in claim 1 wherein:

said cavity is closed at its inner end, said latching segment having masking flanging positioned for closing said cavity one end when said latching segment is in its said latching position.

3. The security seal set forth in claim 2 wherein said shackle and retainer are of integral one piece construction formed from a plastic having elastic memory characteristics.

4. The security seal set forth in claim 1 wherein:

said latching cavity wall portions are in substantially parallel relation with said retainer flange portion, said one end of said shackle being at the projecting end of said flange portion, said shackle, said flange portion and said cavity bore being in substantially coplanar relation.

5. The security seal set forth in claim 1 wherein:

said cavity is defined by an imperforate circumambient wall structure, with said cavity being closed at its inner end, said latching segment having a masking collar positioned for closing said cavity one end when said latching segment is in its said latching position.

6. The security seal set forth in claim 5 wherein:

a frangible connection connects said latching segment with said shackle.

* * * * *